US005586617A

United States Patent [19]

England et al.

[11] Patent Number: 5,586,617

[45] Date of Patent: Dec. 24, 1996

[54] AUTOMATIC EMERGENCY ESCAPE FOR TALL STRUCTURES

[75] Inventors: Robert L. England, 1443 Tamara Ct., Benicia, Calif. 94510; Donn E. Albert, Florissant, Mo.

[73] Assignee: Robert L. England, Benicia, Calif.

[21] Appl. No.: 315,793

[22] Filed: Sep. 30, 1994

[51] Int. Cl.[6] ..... A62B 1/02

[52] U.S. Cl. ..... 182/238; 182/71

[58] Field of Search ..... 182/238, 233, 182/232, 71

[56] References Cited

U.S. PATENT DOCUMENTS

| | | | |
|---|---|---|---|
| 1,200,198 | 10/1916 | Jersild | 182/238 |
| 3,834,671 | 9/1974 | Du Mesnil | 182/238 |
| 3,861,496 | 1/1975 | Hoover . | |
| 4,088,201 | 5/1978 | MacFarlane . | |
| 4,385,679 | 5/1983 | Mulcahy . | |
| 4,437,546 | 3/1984 | Marinoff . | |
| 4,520,900 | 6/1985 | Orgeron | 182/238 |
| 4,550,801 | 11/1985 | Forrest . | |
| 4,616,735 | 10/1986 | Orgeron | 182/238 |
| 4,653,609 | 3/1987 | Devine | 182/238 |
| 4,671,384 | 6/1987 | Sing . | |

*Primary Examiner*—Alvin C. Chin-Shue

*Attorney, Agent, or Firm*—Townsend and Townsend and Crew LLP

[57] ABSTRACT

A device for safely lowering persons from upright structures such as buildings during an emergency at a safe, predetermined speed of no more than about four feet per second irrespective of the weight of the person being lowered. The device has a drum about which a cable is wound, a gear pump driven by the drum via a reduction gear train, and a hydraulic circuit which includes the gear pump and a flow control valve which maintains a constant hydraulic fluid flow through the circuit irrespective of the weight of the person being lowered and, therefore, also irrespective of the fluid pressure generated by the pump during operation. The hydraulic circuit is in fluid communication with a hydraulic fluid tank having an exterior surface dimensioned to cool the hydraulic fluid and prevent its temperature from rising by more than about 200° F. above the ambient temperature during operation of the device. A handle can be used for manually rewinding the cable about the drum, and the hydraulic circuit includes a one-way branch line, controlled with a check valve, to permit countercurrent circulation of hydraulic fluid during the rewinding of the cable. The gear train causes the gear pump to rotate at a substantially higher rate of rotation than that of the drum to facilitate the control of the fluid flow in the hydraulic circuit. The increase in fluid volume results in improved flow control in the flow control valve.

1 Claim, 4 Drawing Sheets

AUTOMATIC EMERGENCY ESCAPE FOR TALL STRUCTURES

BACKGROUND OF THE INVENTION

During emergencies, typically fires, it becomes often necessary to rapidly evacuate persons from the affected structure such as a highrise building (hereinafter simply referred to as "building"). This can become difficult, dangerous and impossible if access to the internal fire escapes is blocked; for example, by flames and smoke. In such cases the only available escape route may be along the exterior of the building, but ordinarily that route is, under the best of circumstances, available to only the occupants of the lowest floor or floors of the building.

While floors at intermediate heights of the building could be evacuated via ladders, provided they are available at all, occupants of the higher floors are in great danger unless the fire can be controlled in time before it reaches and/or spreads throughout such floors.

Thus, attempts have been made in the past to provide occupants of buildings with a way to escape along the exterior of the building during emergencies. Typically, this involved providing a rope or cable that is suitably anchored to the building, a mechanism frictionally engaging the rope and adapted to suspend the escaping person therefrom, and means operable by the escaping person for controlling friction to thereby lower himself at a controlled, sufficiently low speed to prevent injury upon the person's arrival on the ground. Exemplary of prior art efforts for escaping along the exterior of buildings are U.S. Pat. Nos. 5,145,036; 4,934,484; 4,705,142; 4,679,654; 1,190,389; and 702,858.

The prior art devices have a number of drawbacks, including their reliance on power from the person descending to slow the rate of descent, their need for some skill on the part of the descending person to properly operate it, and their inability for an efficient and quick reuse by several persons requiring evacuation because the devices are typically limited for use by one person only. They are therefore more suitable for individual escape mechanisms, adapted to be carried around by the intended user, but not well suited for permanent installation at various building sites as a standby to quickly evacuate several persons if and when an emergency arises.

From operational and safety points of view, it would of course be preferred if buildings could be fitted with escape devices which, on demand, automatically lower a person at a safe, controlled speed along the exterior of buildings without relying on the strength, dexterity, skill or, indeed, consciousness of the person being lowered. Such devices could be powered by electric motors, and appropriate mechanical, electromechanical and/or electronic controls are available to operate the devices. The problem with this approach is that in emergencies it is possible, indeed it is to be expected, that no power is available. Hence, power-driven escape devices are not feasible because the likelihood that they will be inoperative is greatest at the very moment when they are needed.

Accordingly, there is presently a need for a self-contained device which, without the need for external power and/or personal strength and skill, can lower persons during emergencies from the building to the surrounding ground at a controlled, safe speed at which injuries due to impact with the ground are prevented.

SUMMARY OF THE INVENTION

The present invention enables persons to escape buildings, even the uppermost floors of tall highrise buildings, during emergencies such as fires. This is achieved by using the energy of the person being lowered to drive the device and, without the need for external power and/or any controls, to further use the weight of the person to determine and control his or her rate of descent by maintaining it at a safe rate. In this manner, a person can escape from a building floor by simply attaching himself to the device, as is more fully described below, stepping outside the building, and then, as a result of no more than stepping outside the building and without assistance from anyone or any outside power, slowly descending to the ground. Once on the ground, the device can be reset to enable others to escape.

A first aspect of the present invention involves a method for lowering a person along the upright exterior of a building by providing a cable of sufficient length to reach the surrounding ground, suspending the person from an end of the cable, and lowering the person while applying a braking force to the cable so that the person descends gravitationally downward at a predetermined, constant speed. In a presently preferred embodiment of the invention, this is a speed of about four feet per second.

To maintain this speed, the braking force applied to the cable is controlled as a function of and solely in response to the suspended person's weight by unwinding the cable from a drum and braking the cable speed with a gear pump. The latter is in a hydraulic circuit which includes a flow control valve that keeps the rate of flow in the circuit constant irrespective of the weight of the descending person.

As a result, and as briefly indicated above, the act of becoming suspended from the free cable end not only automatically generates a braking force, by virtue of a gear pump driven by the cable drum, but further automatically adjusts this braking force to the actual weight of the suspended person so that his/her rate of descent will always be substantially the same irrespective of his/her weight. There is no need for the person to manipulate anything, indeed there is no need to commence or stop the operation of the emergency exit device of the present invention, because both are automatically initiated when the person steps out of the building to become suspended from the cable and again upon his/her arrival on the ground. Moreover, the device requires no outside power, so that power outages, frequently encountered during emergencies, have no effect.

A second aspect of the present invention is directed to the construction of the emergency escape device. Generally speaking, such a device includes a support frame for permanent attachment; e.g. by way of bolts or welding, to the structure in the vicinity of an opening such as a window through which persons can escape in the event of an emergency. A drum is rotatably mounted to the frame and has a cable wound about its periphery, a free end of the cable being adapted to be attached to the person that is to be lowered to the ground.

A gear pump includes a rotatable shaft that is located exteriorly of and proximate to the drum. A drive connection, such as a gear train or a chain drive, for example, couples the gear pump to the drum so that rotation of one causes rotation of the other one. The drive further preferably rotates the shaft of the gear pump at a substantially higher rate than that of the drum to facilitate the control of the pump, as is further discussed below.

The hydraulic circuit communicates with a hydraulic fluid storage tank mounted to the frame. The circuit includes a flow control valve downstream of the pump for maintaining the hydraulic fluid flow rate in the circuit, and thereby through the pump, substantially constant irrespective of the fluid pressure generated by the pump. Since the hydraulic fluid is a noncompressible liquid, the constant fluid flow rate in the circuit results in a constant rate of rotation of the gear pump and therewith also of the drum. Thus, the speed at which cable is paid out from the drum does not change irrespective of the weight of the person suspended from the cable.

In a presently preferred embodiment of the invention the flow control valve is of the type which has one or more orifices through which the hydraulic fluid flows, the effective open area of which changes in response and inversely to a change in the fluid pressure generated by the pump. Such gear pumps are commercially available as standard, off-the-shelf items. As such, the pumps are not only effective and efficient, they are also relatively inexpensive, thereby lowering the cost of the emergency exit device of the present invention.

At present applicant prefers to use fixed displacement gear pumps available from the Parker Hannifin Corporation, Fluid Power Pump Division, of Otsego, Mich. 49078, and referred to as Series H pumps, which have a maximum pressure of 2500 psi (172 bar) and a maximum speed of 4000 rpm. This pump limits the generated maximum pressure to about 2500 psi, which is important to protect internal seals and is well below 4000 psi, a pressure which is so large that it is generally considered to be dangerous. When installed in the escape device of this invention as disclosed herein, the pump will generate a pressure of between about 260 psi and 2080 psi when persons weighing between 50 lbs. and 400 lbs. are being lowered.

The flow control valve in the hydraulic circuit is also preferably an off-the-shelf item to assure ready availability and relatively low cost. Applicant presently prefers to use pressure-compensated flow control valves available under the trademark MANATROL, Series PC, and available from Parker Fluid Power, Hydraulic Valve Division, of Elyria, Ohio 44035. Applicant presently prefers flow control valve Model PCK820S, which is particularly well adapted for use with the above-referenced, commercially available gear pump.

The device of the present invention further preferably includes a handle, operatively coupled to the drum, for manually rotating the drum so that the cable can be retracted and rewound after a person has been lowered to the ground. Thus, rewinding too is accomplished without the need for power, which may not be available during the emergency.

To facilitate rewinding, the hydraulic circuit includes a return branch line so that hydraulic fluid circulated by the pump while the cable is rewound can flow in the reverse direction from the tank, through the pump and back to the tank again. A check valve closes the return line when a person is lowered and hydraulic fluid circulates in the operative flow direction.

It is desirable to minimize the amount of hydraulic fluid in the hydraulic circuit and the hydraulic tank to minimize the weight of the device and its size as well as to reduce costs. However, during descents the gear pump converts relatively large amounts of energy into heat, thereby heating the hydraulic fluid. To prevent a degradation of most hydraulic fluids, the fluid temperature should not exceed about 250° F. Increasing the volume of the available hydraulic fluid in and of itself lowers its temperature during operation. To further assist in this regard, the fluid tank is constructed so that a portion thereof; e.g. its sides not attached to the frame, is exposed to the atmosphere and can act as heat exchange surfaces to cool the hydraulic fluid. The tank is preferably constructed so that its effective heat exchange surfaces (which are exposed to the atmosphere) prevent a fluid temperature rise of more than about 200° F. after five consecutive descents of persons with a maximum design weight of about 400 lbs.

In addition to the control of temperature, it is important to control the rate of fluid flow in the hydraulic circuit and, thereby, to the gear pump. At low rates of gear pump rotation, such control becomes more difficult and unreliable because the liquid flow rate through the pump and, more importantly, through the flow control valve can become too small. In such an event even relatively minor deviations in the flow rate can lead to undesirable and potentially dangerous changes in the rate of descent along the exterior of the building.

To prevent this, the present invention employs a reduction gear drive which increases the speed of rotation of the gear pump by a factor in the range of between about 3:1 to 10:1, and preferably of about 5:1 over the rate of rotation of the drum. By giving the drum a relatively small diameter, in a preferred embodiment about seven inches, the gear pump will rotate at a rate of at least about 500 rpm when the cable payout speed is about four feet per second. At that speed the hydraulic fluid flow rate in the circuit should be in the range between about two and four gallons/minute with a presently preferred flow rate of about three gallons/minute. The above-identified Parker gear pump generates a flow rate of about three gallons/minute at a gear pump rotation of about 500 rpm, which assures good fluid flow control for all components of the hydraulic circuit.

DESCRIPTION OF THE PREFERRED EMBODIMENT

Figure 1:
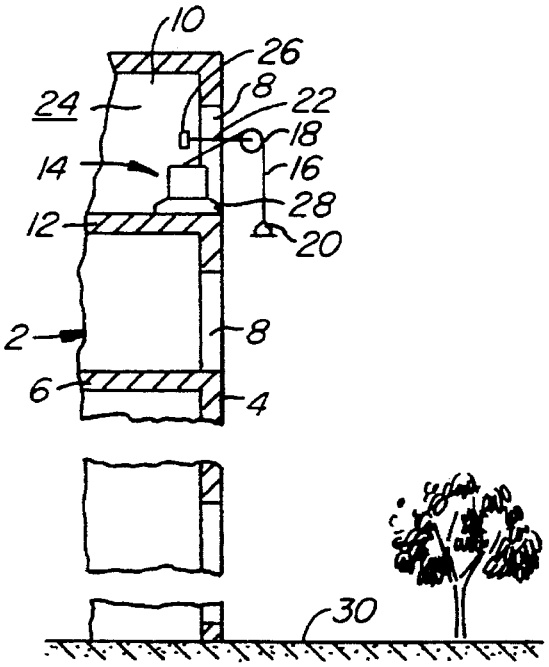
FIG. 1 is a schematic, side elevational view showing a building fitted with an emergency escape device constructed in accordance with the present invention.

Referring first to FIG. 1, a structure such as a highrise building 2 has an upright, exterior wall 4 and is divided into multiple, vertically separated floors 6. The upright walls include openings, such as floor-to-ceiling windows 8 which, upon the removal (e.g. breakage) of a window pane (not shown), provide access from an interior 10 of the building to the exterior thereof. One of the floors; say, an upper floor 12, includes an emergency exit device 14 constructed in accordance with the present invention.

A cable, constructed of a heat-resistant, non-flammable material, such as steel or non-combustible (at the encountered temperatures), e.g. glass or carbon filaments, to prevent damage to the cable from heat or flames generated during a fire, extends from the device over a pulley 18 and terminates in a free end to which a suitable connector 20 is secured. The connector may be part of a harness (not shown) which can be applied to a person to secure the person to the free end of the cable. The construction of such connectors and harnesses is well known and is therefore not further described herein.

Pulley 18 is mounted at the end of a cantilever arm 22 which extends through opening 8 sufficiently far outwardly so that cable 16 and connector 20 attached thereto are clear of the exterior wall 4. Pulley 18 is preferably sufficiently horizontally spaced from the exterior so that a person suspended from the cable clears, i.e. does not touch the building exterior, to prevent that person from sliding along the exterior during his or her descent. In the illustrated embodiment of the invention, the connector arm is attached to a pivot 26 mounted to an inside wall 24 of the building so that the arm can swing between its extended position (shown in FIG. 1) and an inoperative position, in which the arm and the pulley are in the interior 10 of the building, approximately at a position 180° offset from the operative position.

The cantilever arm can of course be differently attached to the building. For example, it can be attached to and be an integral part of exit device 14, it can be pivotally attached to other walls of the building, including interior floor 12, the ceiling or the exterior wall 4 (in which event pivot 26 may not be needed). Cable 16 can also be paid out from exit device 14 so that it runs over an edge 28 between floor 12 and exterior building wall 4. Although such an arrangement creates normally undesirable friction, particularly during the descent of a person, it nevertheless can be an acceptable arrangement because the exit device of the present invention is only rarely used, and since the cable is constructed of such materials as steel, occasional uses will not noticeably affect its integrity. When the cable is paid out over edge 28, it is preferred to round the edge where the cable can contact it to reduce friction and assure a smooth movement of the cable over the edge.

In use, a person about to be lowered from upper floor 12 steps into or otherwise applies the harness, attaches it to cable end connector 20 (if not already attached), and then steps through opening 8 to the exterior of the building. As will be described in more detail below, as soon as the person's weight becomes suspended from the cable, the exit device 14 of the present invention self-initiates a controlled payout of the cable at a predetermined, safe speed, preferably at about four feet per second, until the person reaches ground 30 adjacent the building. Once on the ground, the person's weight is no longer suspended from the cable, which automatically terminates the payout of cable. On the ground, the person steps out of the harness and the cable can thereafter be retracted to raise the harness to upper level 12 for either standby storage and use in the event of another emergency, or for lowering the next person to the ground under the existing emergency.

Figure 2:
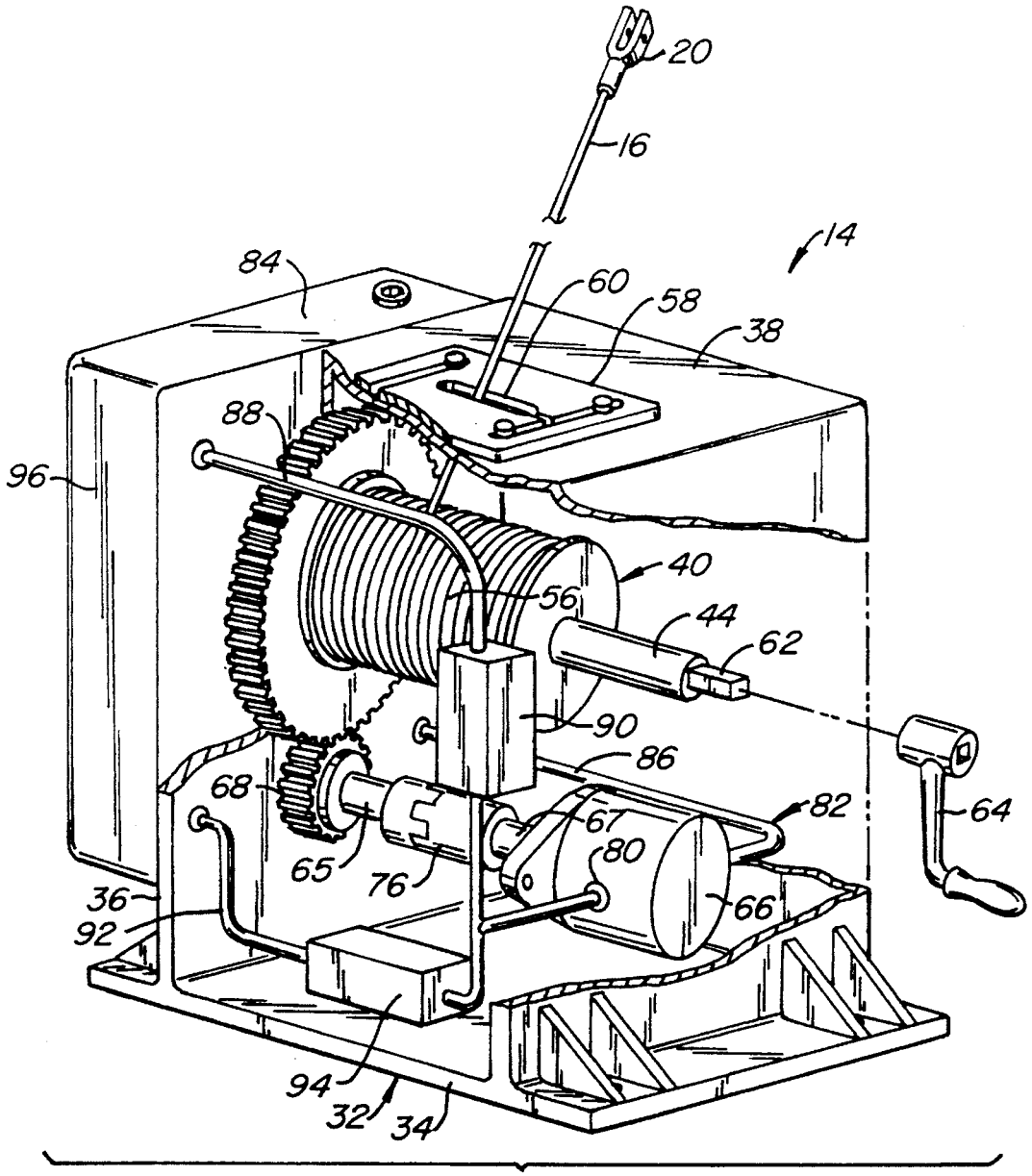
FIG. 2 is a schematic, elevational, perspective view of the emergency device of the present invention.
Figure 3:
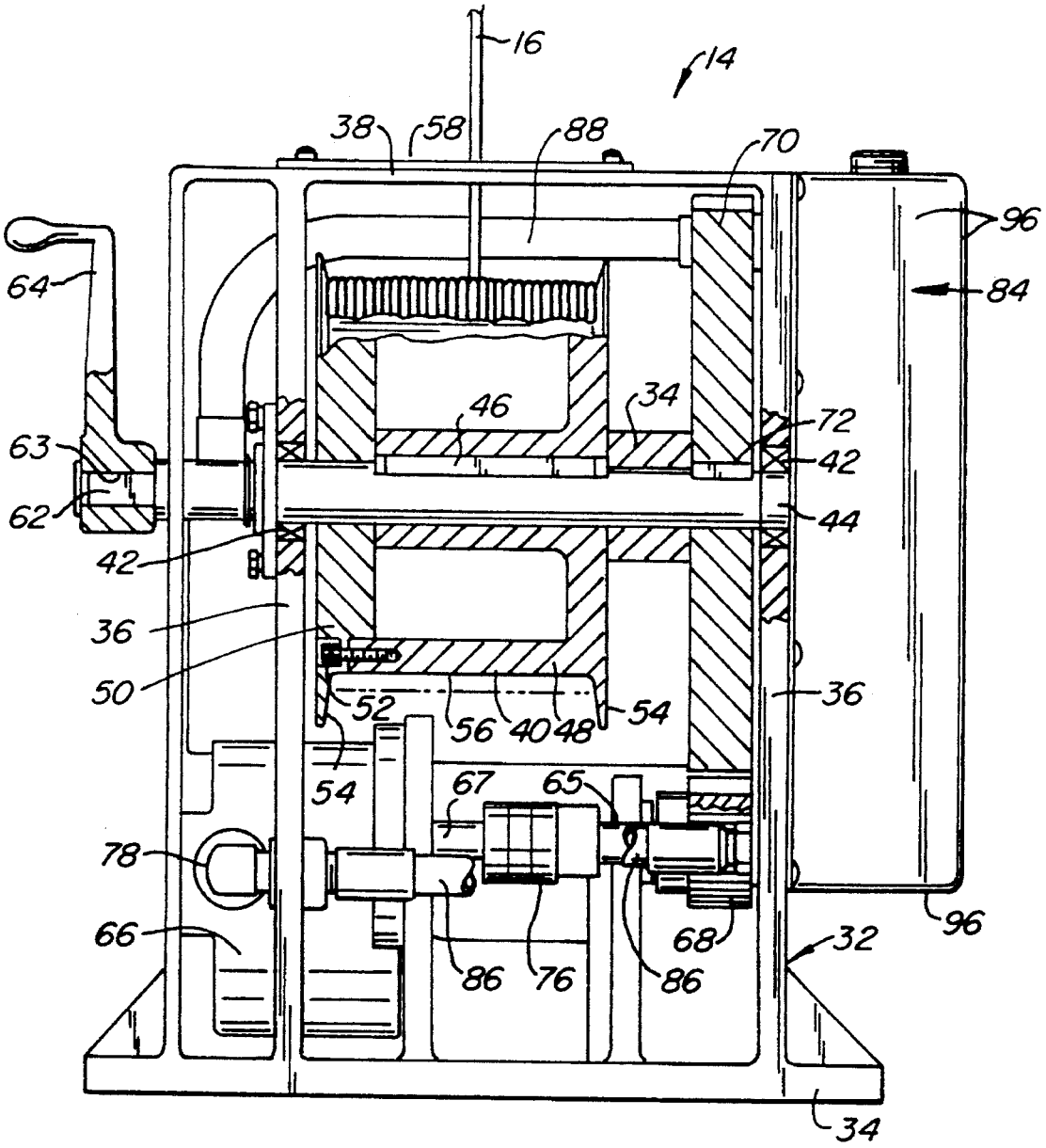
FIG. 3 is a side elevational view, with parts broken away and partially in section, of the device illustrated in FIG. 1.

Referring now to FIGS. 2 and 3, the construction and operation of exit device 14 of the present invention are described in detail. The device includes a frame 12 forming a base 34 for attachment to building floor 12 (not shown in FIGS. 2 and 3) and a pair of opposed, spaced-apart upright supports 36 the upper ends of which terminate in and are securely interconnected by an upper, generally horizontal top plate 38. In a preferred embodiment, the frame is a metal casting.

A drum 40 is nonrotatably mounted on a shaft 44 with a key 46. The shaft is journalled in bearings 42 housed in appropriately sized holes formed in upright supports 38.

In a presently preferred embodiment of the invention, the drum is made of two cast sections 48, 50 which are suitably secured to each other; for example, with bolts 52. Other methods of connection, such as welding, bonding, brazing, shrink fitting or directly threading the two drum sections to each other (not shown), can of course be substituted. The drum sections define a cylindrical cable winding periphery 34 which terminates in radially outwardly extending drum end flanges 54. Cable 16 can be wound onto or paid out from the drum periphery by rotating the drum in one or the other direction.

Figure 4:
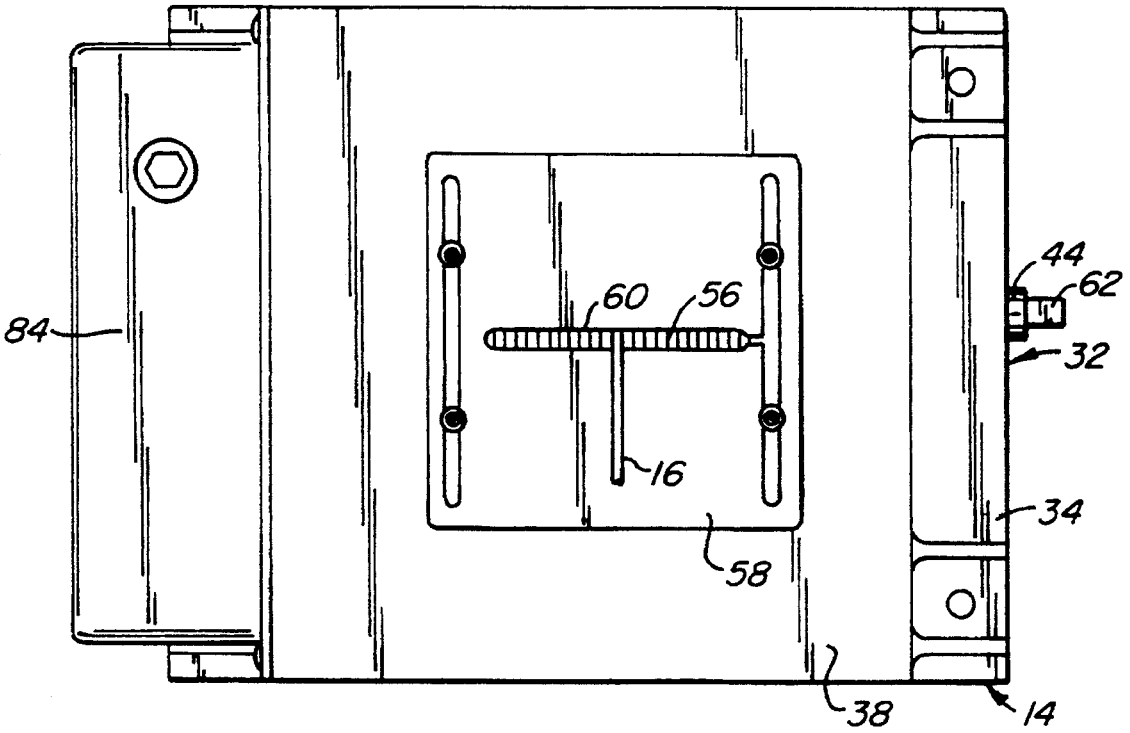
FIG. 4 is a plan view of the device shown in FIG. 3.

In a presently preferred embodiment, the cable is paid out from the drum in a generally upward direction (as illustrated in FIG. 3) and extends through a guide plate 58 bolted to top plate 38 and having a slit 60 that extends parallel to and approximately over the length of cable winding drum periphery 56 as shown in FIG. 4. To minimize friction and cable bending during use, the longitudinal edges of slit 60 are rounded (not shown). When installed in a building and ready for use, cable 16 extends at an angle from the slit to pulley 18 as is generally illustrated in FIG. 1.

One end of shaft 44 extends past frame 32 and terminates in a stub shaft 62 onto which a hand crank 64 can be nonrotatably attached; e.g. by giving the stub shaft and bore 63 of the crank a noncircular cross-section; e.g. a square, serrated or the like cross-section, or by keying the crank to the end of the shaft so that shaft 44, and therewith drum 40, can be manually rotated with the crank for retracting cable 16 and winding it about the drum periphery.

To control and limit the speed with which the drum rotates when a person is being lowered to the ground, the shaft is rotationally coupled to a gear pump 66 by a drive connection. In a preferred embodiment of the invention, the latter is formed by a sprocket gear 68 nonrotatably carried on a drive shaft 65. A coupling 76 connects the drive shaft to the shaft 67 of the gear pump. A cooperating spur gear 70 is nonrotatably secured to drum shaft 44 by key 72. A spacer 74 may be provided for maintaining a fixed distance between the spur gear and drum 40.

As is best seen in FIG. 2, an inlet 78 (shown in FIG. 3) and an outlet 80 of the gear pump are in a hydraulic circuit 82 which begins and terminates at a hydraulic fluid tank 84 attached to frame 32 of the exit device. The hydraulic circuit has an intake line 86 which extends from the tank to inlet 78 (shown in FIG. 3) of the pump and a return line 88 which extends from outlet 80 of the pump back to tank 84. A constant flow control valve 90 in the return line is located downstream (during normal operation) of the pump 3.5 outlet, and it controls the rate of fluid flow through the hydraulic circuit so that the flow remains constant irrespective of the fluid pressure generated by the pump in the return line and, therefore, also irrespective of the weight of the person being lowered to the ground during an emergency. Its construction is described in more detail below. Since the return line draws no liquid out of the tank, it can terminate at a relatively higher portion of the tank than where the intake and branch lines terminate because both of the latter must draw hydraulic fluid out of the tank during operation of the pump.

The hydraulic circuit further includes a branch line 92 which is in fluid communication with the return line 88 upstream (during normal operation) of flow control valve 90. A check valve 94 in the branch line prevents flow therein in a direction away from pump 66 so that hydraulic fluid can only flow in the branch circuit from tank 84 to pump outlet 80.

In use, when a person is suspended from cable connector 20, the weight of the person pulls on cable 16, which in turn causes drum 40 to rotate in drum bearings 42, thereby paying out cable and lowering the person to the ground.

Rotation of the drum causes rotation of sprocket drive shaft 65 and, via coupling 76 of gear pump shaft 67, at a rate which corresponds to the rate of rotation of the drum times the gear ratio between spur gear 68 and sprocket 70. In the presently preferred embodiment this ratio is 5:1.

As is well known, rotation of pump shaft 67 correspondingly rotates the pump gears on the inside of the pump (not shown). This rotation causes a vacuum at pump inlet 78, thereby drawing hydraulic fluid via intake line 86 from tank 84, and expels pressurized fluid from outlet 80 into return line 88. Check valve 94 in branch line 92 prevents any fluid expelled from the pump from flowing through the branch line 92.

Flow control valve 90 in return line 88 is set to generate a back pressure and limits the flow rate. The flow rate is selected so that the resulting rate of rotation of gear pump shaft 67 yields a surface speed at the drum periphery 56 which equals the predetermined speed at which the person is to be lowered to the ground; e.g. four feet per second as previously mentioned. Since the hydraulic fluid is not compressible, the gear pump will maintain this rate of rotation irrespective of the torque applied to it and, therefore, also irrespective of the weight suspended from cable connector 20.

After the person has arrived at the ground and has been disconnected from the cable, the cable is rewound onto the drum with hand crank 64.

During rewinding, the drum and therewith the gear pump rotate in the opposite direction. This creates a vacuum at pump outlet 80 and generates a reverse flow of hydraulic fluid through the pump; that is, into outlet 80 and out of inlet 78. This flow direction is permitted by check valve 94 so that, during rewinding of the cable, hydraulic fluid flows through branch line 92, check valve 94, pump 66 and then via inlet line 86 of the hydraulic circuit back into tank 84. The inlet line contains no flow restrictors so that there is substantially no resistance generated by the pump, to make the rewinding of the cable relatively easy and effortless.

As soon as the free cable end has arrived at the upper floor 12, the exit device of the present invention is ready for reuse and will cause gear pump 66 to again apply the required braking force to drum 40 so that the next person can descend to the ground at the predetermined speed.

The energy generated by the descending person is to a large extent converted into heat as the gear pump rotates and forces hydraulic fluid through flow control valve 90 back into tank 84. Since high temperatures can damage hydraulic fluid, it is important to control its temperature. This is at least partially achieved by providing the hydraulic circuit 82, including tank 84, with a sufficient volume of fluid to moderate its temperature rise. To prevent a repeated use of the emergency device from heating the hydraulic fluid to an unacceptably high temperature; e.g. to more than about 250° F., without requiring an excessive amount of hydraulic fluid, it is further preferred to mount tank 84 so that its walls 96 (except for the wall attached to frame 32) are exposed to the surrounding atmosphere so that there will be heat transfer from the hydraulic fluid via the tank walls to the atmosphere once the temperature of the fluid exceeds the ambient temperature. The precise size of the heat exchange walls of tank 84 depends on the volume of hydraulic fluid, the expected number of repetitive uses during a given emergency; i.e. one use following shortly after another, the material and thickness of the tank walls, and the expected maximum ambient temperature. Those skilled in the art know how to dimension and shape (e.g. the use of undulating walls to increase their heat exchange surfaces without noticeably increasing the tank volume) the tank walls to effect the desired rate of heat exchange under the conditions for which the device is to be designed.

Figure 5:
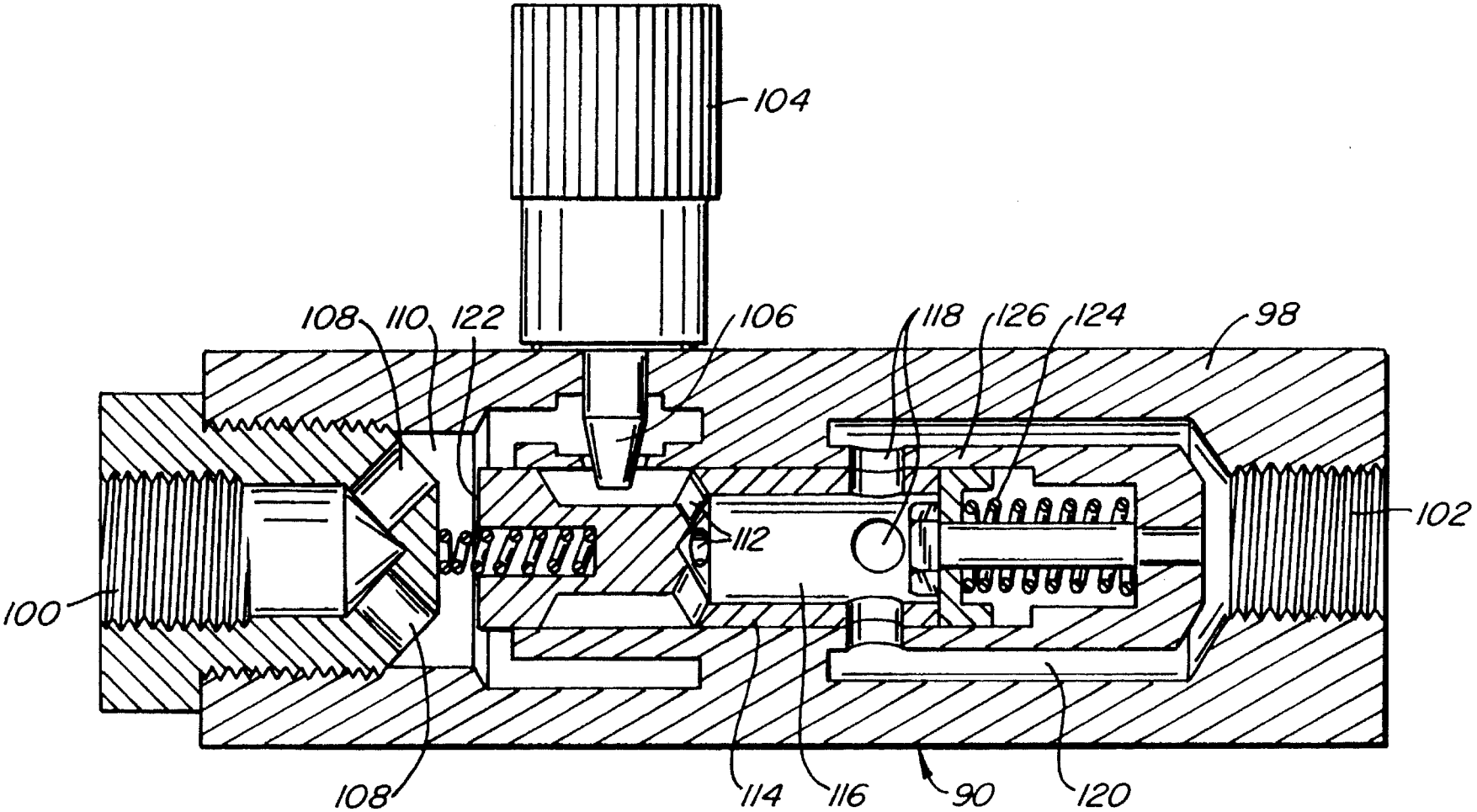
FIG. 5 is a sectional view of a constant flow control valve used in the device illustrated in FIG. 2.

Referring to FIGS. 3 and 5, the construction and operation of flow control valve 90 will be briefly described. As earlier mentioned, such valves are available, for example, from Parker Fluid Power, Hydraulic Valve Division, of Elyria, Ohio. For purposes of the present invention, such valves may be preset to permit a predetermined flow rate or they may be adjustable to change the flow rate. FIG. 5 illustrates an adjustable flow control valve, although it is presently preferred not to provide adjustability to prevent an unauthorized tampering of the valve during its long standby periods. The presently preferred Parker valve Model PCK820S has a preset flow rate of three gallons per minute.

The adjustable valve illustrated in FIG. 5 has a generally cylindrical housing 98 and has an intake port 100 and an outlet port 102 at the respective ends of the housing. A flow control adjustment knob 104 (not used in the preferred embodiment of the invention) permits retraction and extension of a conical valve member 106 on the interior of the housing to vary the size of an annular opening between the conical valve member and the opposing valve seat.

In operation, hydraulic fluid enters intake port 100 and flows via bores 108 into an open space 110 on the interior of the housing. From there the fluid flows past conical valve member 106 and interior holes 112 in a longitudinally reciprocable spool 114 into an axially extending chamber 116 formed by the spool. From the chamber the fluid flows past sets of compensating orifices 118, through an annular space 120, and out of outlet port 102.

When the flow control valve 90 operates at its lowest operating pressure, spool 114 is positioned as is illustrated in FIG. 5 when the flow generated by gear pump 66 rises; say, as the result of a relatively heavier person being lowered to the ground, correspondingly higher pressure appears at inlet port 100 of the valve, thereby correspondingly raising the fluid pressure in interior space 110. The increased pressure generates an increased force acting on end face 122 of spool 114. This moves the spool in a downstream direction (to the right as seen in FIG. 5) in opposition to a force generated by a spring 124 acting against the other end of the spool, until the force generated by the increased fluid pressure equals the spring force. This axial movement offsets the sets of compensating orifices 118 formed in spool 114 and a surrounding portion 126 of the housing, thereby effectively reducing the area of the compensating orifices and correspondingly reducing the area through which the fluid can flow. The reduction in the effective open area of the compensating orifices is selected, by appropriately configuring the size of the spool, the compensating orifices and spring 124, so that the fluid flow rate through the valve stays constant; e.g. at three gallons per minute. In other words, the effective open area of the compensating orifices is reduced in response to higher pressure to maintain the fluid throughput volume constant.

Conversely, when the fluid pressure at inlet port 100 is reduced, the correspondingly reduced force acting on spool face 122 permits spring 124 to axially move the spool in an upstream direction (to the left as seen in FIG. 5) until the compensating orifices in the spool and the surrounding portion 126 of the housing are again aligned.

The flow control valve is selected so that the compensating orifices are aligned when the least amount of fluid pressure is generated by gear pump 66. The valve is constructed and set so that the desired flow rate is achieved when the anticipated minimum weight is applied to cable end connector 20. In a presently preferred embodiment of the present invention, the minimum weight is 50 lbs.; e.g. the weight of a young child of sufficient age and ability to be lowered to the ground alone.

What is claimed is:

1. Apparatus for lowering persons during an emergency along an upright exterior of a structure to the ground surrounding the structure at a safe, predetermined speed, the apparatus comprising: a drum adapted to be attached to the structure and a cable wound about the drum and of sufficient length so that a free end of the cable can reach the ground, the drum being rotatable in a first direction for paying out the cable and lowering the free end thereof to the ground; a hydraulic circuit including a gear pump operatively coupled to the drum so that rotation of the drum causes the gear pump to operate and generate a flow of hydraulic fluid through the circuit; a flow control valve interposed in the hydraulic circuit limiting the rate of flow through the hydraulic circuit to therewith control and limit a rate of rotation of the drum so that the cable is lowered at said predetermined speed when a load is applied to its free end irrespective of a fluid pressure generated by the gear pump; a hand crank operatively coupled with the drum for manually rotating the drum in a second direction opposite the first direction to thereby rewind the cable about the drum and raise the free end of the cable from the ground; and means independent of the flow control valve for preventing the flow control valve from affecting the rate of rotation of the drum in the second direction; a housing enclosing the drum including an elongated slot parallel to an axis of the drum and extending over a length of the drum about which the cable is wound when the cable is fully retracted for guiding the cable as it is paid out and rewound; and a container for holding a quantity of the hydraulic fluid, fluidly coupled with the hydraulic circuit, and disposed outside the housing, the container being sized and shaped so that it holds a quantity of fluid and prevents the fluid in the container from rising above a temperature of about 250° F. even when a plurality of persons in succession use the apparatus for lowering themselves to the ground; whereby a person suspended from the free end of the cable descends along the exterior of the structure at the predetermined speed irrespective of the person's weight and without requiring independent control or external power.

* * * * *